US009209514B2

(12) United States Patent
Sivalingam

(10) Patent No.: US 9,209,514 B2
(45) Date of Patent: Dec. 8, 2015

(54) BODY-WORN ANTENNA

(71) Applicant: MOTOROLA SOLUTIONS, INC., Schaumburg, IL (US)

(72) Inventor: Parameswaran A. Sivalingam, Gelugor (MY)

(73) Assignee: Motorola Solutions, Inc., Schaumburg, IL (US)

( * ) Notice: Subject to any disclaimer, the term of this patent is extended or adjusted under 35 U.S.C. 154(b) by 214 days.

(21) Appl. No.: 13/963,453

(22) Filed: Aug. 9, 2013

(65) Prior Publication Data

US 2015/0042523 A1 Feb. 12, 2015

(51) Int. Cl.

| | |
|---|---|
| ***H01Q 1/12*** | (2006.01) |
| ***H01Q 1/27*** | (2006.01) |
| ***H01Q 1/24*** | (2006.01) |

(52) U.S. Cl.

CPC ..... *H01Q 1/273* (2013.01); *H01Q 1/245* (2013.01)

(58) Field of Classification Search

CPC ..... H01Q 1/27; H01Q 1/273; H01Q 1/245
USPC ..... 343/718
See application file for complete search history.

(56) References Cited

U.S. PATENT DOCUMENTS

| | | | | |
|---|---|---|---|---|
| 2,576,128 | A * | 11/1951 | Lense | 343/718 |
| 3,902,118 | A * | 8/1975 | Ikrath et al. | 455/100 |
| 6,377,216 | B1 | 4/2002 | Cheadle et al. | |
| 6,483,469 | B2 * | 11/2002 | Boyle | 343/718 |
| 7,471,258 | B2 | 12/2008 | Hsu et al. | |
| 7,609,071 | B2 | 10/2009 | Iwai et al. | |
| 7,630,743 | B2 | 12/2009 | Uejima et al. | |
| 7,852,272 | B2 | 12/2010 | Imano et al. | |
| 7,956,818 | B1 | 6/2011 | Hsu et al. | |
| 7,969,369 | B2 * | 6/2011 | Wertman et al. | 343/718 |
| 8,138,978 | B1 | 3/2012 | Vier et al. | |
| 2007/0028532 | A1 | 2/2007 | Douglas et al. | |
| 2012/0293382 | A1 | 11/2012 | Matthews et al. | |
| 2013/0069846 | A1 | 3/2013 | Chang | |

FOREIGN PATENT DOCUMENTS

| | | | |
|---|---|---|---|
| GB | 2381952 | A1 | 5/2003 |
| WO | 2008094927 | A1 | 8/2008 |
| WO | 2012156872 | A1 | 11/2012 |
| WO | 2012176217 | A1 | 12/2012 |

OTHER PUBLICATIONS

Wang et al—"A Low SAR Whip Type Mobile Handset Antenna"—11th International Conference on Antennas and Propagation—Apr. 2011—Publication No. 480—pp. 352-355.

* cited by examiner

*Primary Examiner* — Hoang V Nguyen
(74) *Attorney, Agent, or Firm* — Barbara R. Doutre

(57) ABSTRACT

A flexible wire radiating element for a body-worn antenna has a length that meets a specified absorption rate (SAR) for a given transmit power, nominal frequency, and separation distance, and allows a higher transmit power than that achievable with a half wavelength element but is within substantially one decibel of efficiency. Using a plot of SAR over length, a minimum length necessary to meet the SAR limit is then mapped to a length corresponding to a peak in a horizontal efficiency plot.

27 Claims, 3 Drawing Sheets

BODY-WORN ANTENNA

FIELD OF THE DISCLOSURE

The present disclosure relates generally to antennas for portable radio devices, and more particularly to body-worn antennas for covert use in high power applications.

BACKGROUND

Portable radio devices are used in a wide variety of communication applications. A popular configuration of a portable radio device is as a two-way radio. Two-way radios operate using half duplex communication, where the device is either transmitting, receiving, or idle/monitoring one or more channels. Transmission is conventionally controlled using a "push to talk" button, referred to as PTT operation, but transmission can also be controlled by voice activity where, upon a user speaking, the radio device commences transmitting until the user stops speaking. Such voice activity detection (VAD) operation is especially desirable in applications where it may be inconvenient for the user to manually operate the radio, such as, for example, in the case of emergency personnel or in the case of covert applications.

Covert applications involve the user wearing the radio device in a manner that cannot be seen. As a result, the antenna used by the radio is in close proximity to the wearer's body which presents an issue with regard to specific absorption rate (SAR). SAR refers to the exposure of the body to electromagnetic radiation, which is typically a legally regulated parameter. In order to comply with SAR limits for covert applications the radiated power is typically cut back to meet the required SAR limit. Of course, it would be desirable to be able to transmit at full power.

Accordingly, there is a need for a method and apparatus for an antenna and arrangement that allows use of a covert radio device that allows full power transmission while meeting SAR limits.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
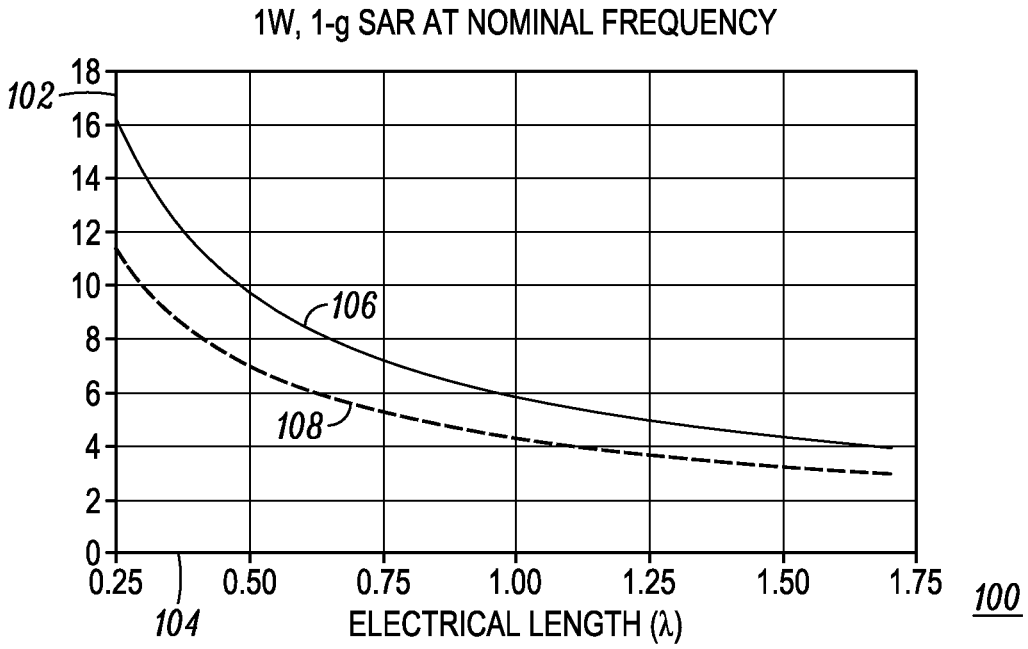
FIG. 1 is a graph chart of specific absorption rate with respect to length of a flexible wire radiating element at different separation distances in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Embodiments taught herein include a method of making a body-worn flexible antenna. The method includes determining a minimum length needed for a flexible wire radiating element to meet a desired specific absorption rate (SAR) based on transmit power applied to the body-worn antenna, a nominal transmission frequency, a transmission duty cycle, and a separation distance from a wearer's body. The separation distance is non-zero and less than one inch. The method can further include selecting an electrical length for the flexible wire radiating element of the body-worn antenna based on the determined minimum length. The electrical length corresponds to a peak in radiated efficiency over wavelength of the nominal frequency for an unterminated wire that occurs above one wavelength and is within a preselected efficiency differential of an efficiency of a one half wavelength. The peak corresponds to an actual length that is greater than the determined minimum length. The method further includes connecting a matching network circuit between the flexible wire radiating element having the selected electrical length and an antenna feed point of the body-worn antenna.

FIG. 1 is a graph chart 100 of specific absorption rate at a given nominal frequency with respect to length of a flexible wire radiating element at different separation distances in accordance with some embodiments. Conventionally the electrical length of an antenna used with a portable radio device is on the order of a half wavelength or a quarter wavelength. This operating constraint is one factor that has limited the amount of transmit power that can be efficiently radiated from a body-worn antenna due to specific absorption rate limits since the radiation in a conventional antenna occurs only over a half wavelength or a quarter wavelength. However, it has been realized that the SAR resulting from an antenna can be reduced by lengthening the antenna, as well as maintaining a specific separation distance between the radiating element and the surface of the wearer's body. The graph chart 100 plots SAR at 1 Watt transmit power 102 over electrical length 104 of the radiating element 104, normalized to electrical length, which is a proportion of the wavelength being transmitted or radiated. As can be seen, the effect logarithmically (or inversely exponentially) decreases as the electrical length of the wire increases. The graph 100 shows two plots 106, 108 for different separation distances between the flexible wire radiating element and the surface for which SAR is measured. The first plot 106 can represent, for example, a separation distance of 0.25 inches, and the second plot 108 can represent, for example, a separation distance of 0.5 inches. As can be seen, the second plot 108 has a lower SAR 102 at a given electrical length 104 compared to the first plot 106, which indicates separation distance affects resulting SAR. The plots 106, 108 represent empirically determined results, and which can provide the basis for an approximate equation having the form $Cx^{-a}$ where C and a are constants that can be determined by conventional curve fitting and x is the electrical length. The electrical length is expressed in terms of wavelength of the nominal operating frequency and can be converted to a measured physical length by multiplying the electrical length with the ratio of the speed of light (e.g. $3\times10^8$ meters per second) over the nominal frequency. The SAR 102 scales with effective radiated power. Thus, for example, for a 4 Watt power level, the vertical scale would simply be multiplied by a factor of 4. As can be seen, to achieve a desired SAR, a flexible wire radiating element that is closer (e.g. plot 106) will require a longer length than one that is farther away (e.g. plot 108).

However, simply selecting a wire length at the electrical length that corresponds to the desired SAR limit is insufficient as the horizontal radiated efficiency is not constant (assuming a vertically mounted radiating element) with respect to electrical length. In fact, horizontal efficiency is known to fall off beyond substantially one half wavelength, which is why conventional solutions use a half or quarter wavelength element.

Figure 2:
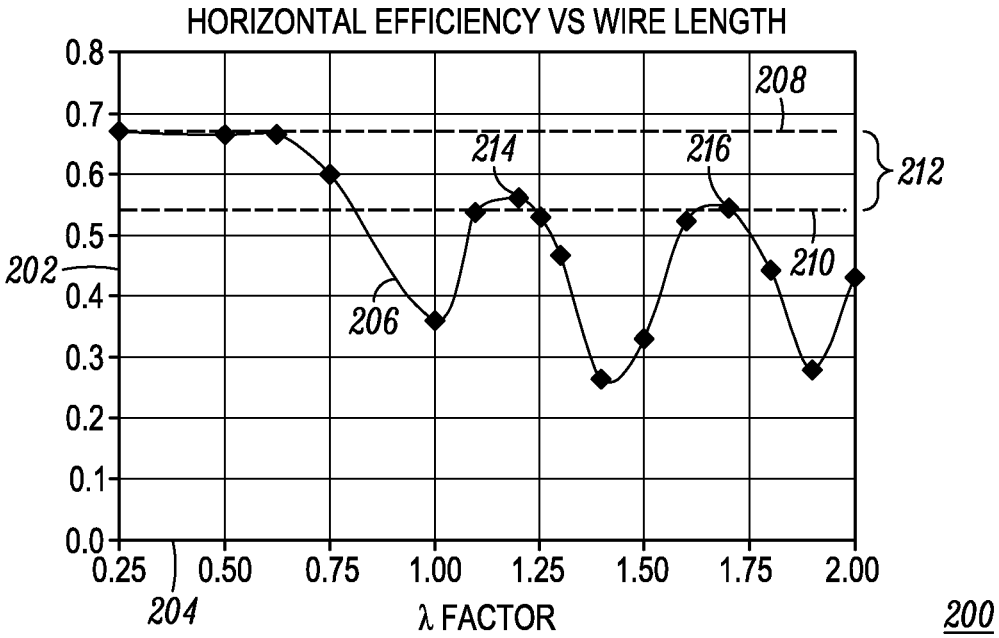
FIG. 2 is a graph chart of radiated efficiency of a flexible wire radiating element over wire length for a given frequency in accordance with some embodiments.

FIG. 2 is a graph chart 200 of horizontal radiated efficiency 202 of a flexible wire radiating element over wire length 204 for a given nominal frequency in accordance with some embodiments. The plot 206 assumes a vertically mounted body-worn flexible wire radiating element that is unterminated. The horizontal efficiency is of interest because propagation occurs away from the radiating element, which for a vertically mounted radiating element is in the horizontal direction around the radiating element. As can be seen, above about one half wavelength the efficiency begins to drop from the half wavelength efficiency 208. However, there can be local peaks 214, 216 in the efficiency plot 206 above one wavelength. In fact it has been determined that peaks can be within an efficiency differential 212 that is within, for example, a one decibel level 210 from the half wavelength efficiency 208. In some embodiments a first peak 214 can occur at 1.2 wavelength and a second peak 216 can occur at 1.7 wavelength of the nominal operating frequency.

Accordingly, once the minimum length needed to meet the desired SAR limit is determined, such as by a plot similar to that of FIG. 1, then an electrical length for the flexible wire radiating element can be picked as a length corresponding to a peak 214, 216 that is not less than the minimum length. The result is a flexible wire radiating element that has a horizontal radiating efficiency substantially close to that of a half wavelength efficiency and meets the desired SAR level for a given nominal operating frequency, separation distance, and transmit power.

Figure 3:
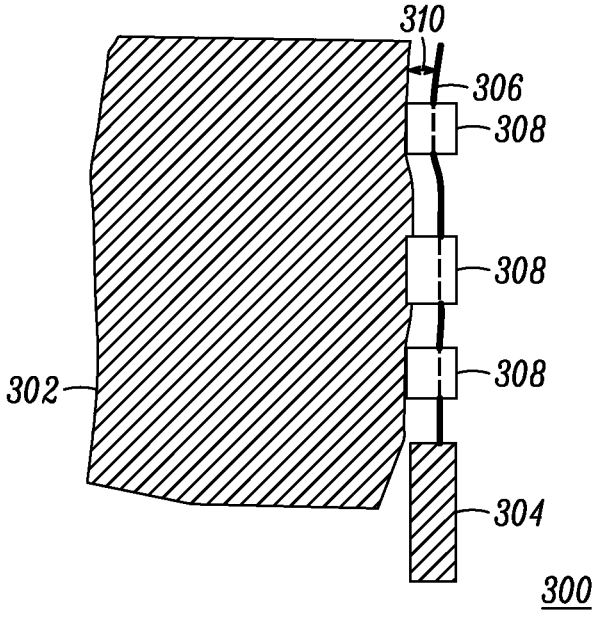
FIG. 3 is a mounting diagram for a flexible wire radiating element of an antenna in a covert application in accordance with some embodiments.

FIG. 3 is a mounting diagram 300 for a flexible wire radiating element 306 of an antenna in a covert application in accordance with some embodiments. A portable radio device 304 and its antenna, including the flexible wire radiating element 306, are mounted on a person's body 302. A desired separation distance 310 is maintained by the use of spacers 308 which are part of a mounting apparatus for the flexible wire radiating element. The spacers 308 can capture the flexible wire radiating element 306 to prevent the flexible radiating wire element from moving, and they can be affixed or attached to the wearer's body 302 such as by using, for example, tape. The arrangement of FIG. 3 allows the wearer to wear the antenna and portable radio device covertly under clothing, for example.

Figure 4:
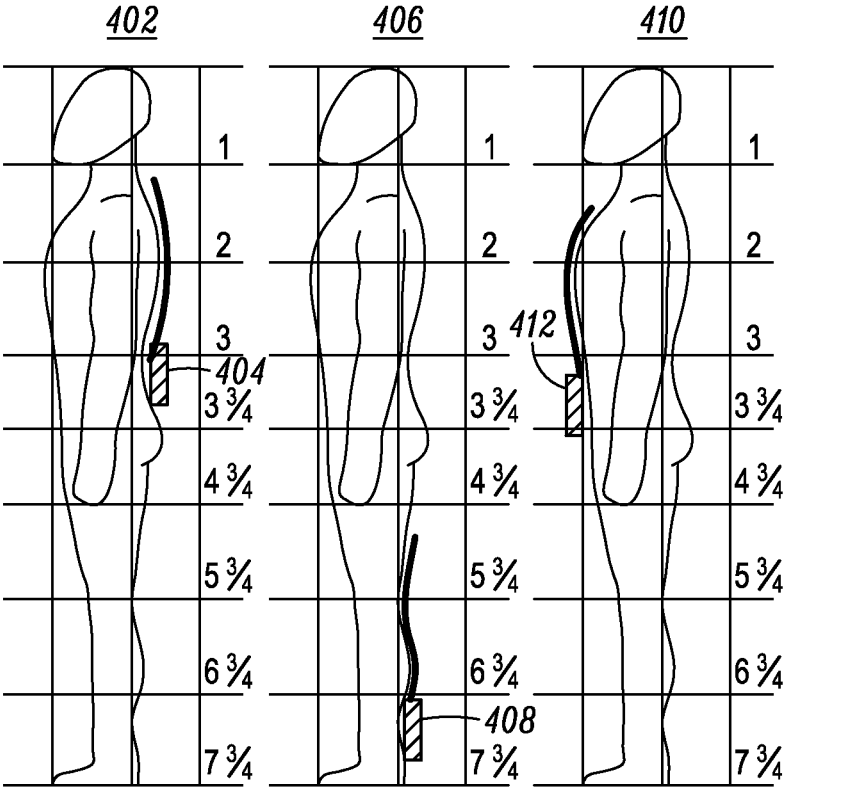
FIG. 4 shows various examples of mounting positions for a portable radio device using an antenna having a flexible wire radiating element in accordance with some embodiments.

FIG. 4 is a diagram 400 of various examples of mounting positions for a portable radio device using an antenna having a flexible wire radiating element in accordance with some embodiments. The grid represents a wavelength scale for commonly used radio frequencies, for example 800 MHz. In a first example 402 the portable radio device 404 is mounted on the small of the wearer's back with the flexible wire radiating element extending up the wearer's back. In a second example 406 a portable radio device 408 can be mounted on the wearer's lower leg with the flexible wire radiating element extending up the wearer's leg. In a third example 410 a portable radio device 412 can be mounted on the wearer's abdomen with the flexible wire radiating element extending up the wearer's thorax. In each example the flexible wire radiating element is separated from the wearer's body by a distance that is non-zero (i.e. not directly against the wearer's body) and not greater than one inch. Some applications will necessitate a distance of half an inch or less, and some applications will require a separation distance of a quarter inch to maintain covertness. By selecting the electrical length to be, for example, more than one wavelength, and by using a mounting apparatus that maintains a selected separation distance, the effective radiated power can substantially exceed that achievable using a conventional half wavelength antenna element. In some embodiments effective radiated power levels in the 3-5 Watt range, or more, are achievable, whereas with a conventional half wavelength element a body-worn antenna must be limited to approximately 2 watts to meet SAR limit compliance.

Figure 5:
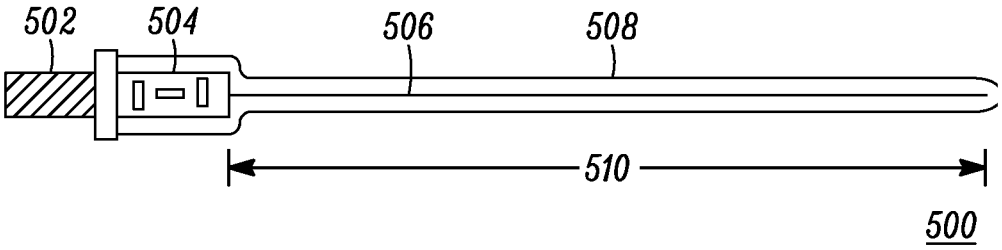
FIG. 5 is an antenna for a portable radio device in accordance with some embodiments.

FIG. 5 is an antenna 500 for a portable radio device in accordance with some embodiments. The antenna 500 has a connector 502 which can be, for example, a threaded connector and serves as a feed point for the portable radio device. Other types of connectors can be used equivalently, such as, for example, a Bayonet Neill-Concelman (BNC) connector. Connected to the feed point is a matching network 504 which can be a passive circuit configuration mounted on a circuit board. The matching network matches the impedance of the flexible wire radiating element 506 to the impedance of the portable radio device output to which the connector 502 is connected. The flexible wire radiating element 506 and matching network 504 can be covered by an insulating material 508 in some embodiments. The flexible wire radiating element 506 has a length that is determined by plots similar to those of FIGS. 1-2, based on the nominal operating frequency, transmit power, and separation distance required for the application.

Figure 6:
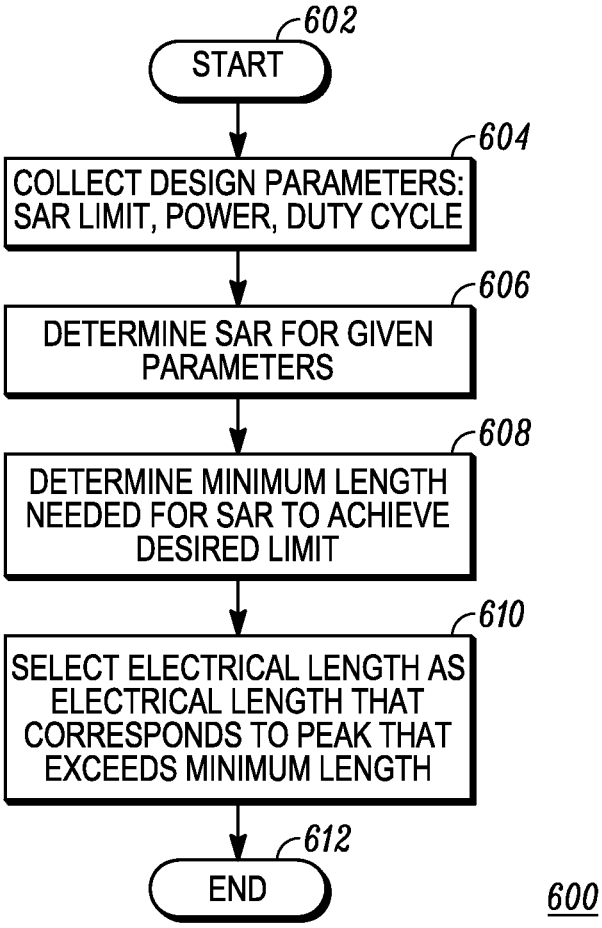
FIG. 6 is a flow chart diagram of a method of making an antenna having a flexible wire radiating element for a portable radio device in accordance with some embodiments.

FIG. 6 is a flow chart diagram 600 of a method of making an antenna having a flexible wire radiating element for a portable radio device in accordance with some embodiments. At the start 602, a designer can have several plots such as those in FIGS. 1-2 available. Furthermore, one or more equations based on those plots can be derived.

For example, it is known that the resulting SAR is directly proportional to the transmit power, the transmit duty cycle, the length and the constant and negative exponential factor $Cx^{-a}$. Thus, the equation can take on the form:

$$S=Pd(c/f)\times Cx^{-a};$$

Where S is the resulting SAR, P is the transmit power, d is the transmit duty cycle, c is the speed of light, f is the transmit frequency, and x is the electrical length expressed as a proportion of wavelength. The factor (c/f) is the wavelength. Multiplying the wavelength by the electrical length x provides a length measure in units of length. The equation can be simplified as follows:

$$S=(Pd/f)Bx^{(1-a)};$$

Where B is the product of c (the speed of light) and C (the constant derived from the plot of SAR vs. length), and where x used in the length factor is combined with $x^{-a}$ derived from the plot of SAR vs. length, resulting as $x^{(1-a)}$. The equation can be solved for x for a given SAR S limit.

Upon deriving the necessary empirical plots and corresponding equation (s), the designer then collects the design parameters in process 604 including the SAR limit, nominal transmit power, and transmit duty cycle. Next the SAR for the given parameters can be determined in process 606. In process 608, based on the results of the previous processes, the minimum actual length necessary to meet the desired SAR can be determined. Once the minimum length necessary to meet the desired SAR is determined, the electrical length that corresponds to a peak in radiated efficiency over wavelength of the nominal frequency for an unterminated wire is determined in process 610. The electrical length can correspond to a peak that occurs above one wavelength and is within a preselected efficiency differential of an efficiency of a one half wavelength. The peak corresponds to an actual length that is greater than the determined minimum length.

For example, if, for a given transmit power level, separation distance, and transmit duty cycle, the determined minimum length correspond to 1.4 wavelengths, and the peaks in the horizontal efficiency plot (e.g. as in FIG. 2) occur at 1.2 and 1.7 wavelengths, an electrical length of 1.7 wavelengths must be selected as 1.2 wavelengths is less than the determined minimum length of 1.4 wavelengths. However, in other embodiments, where, for example, the determined minimum length is 0.9 wavelengths, the length of the flexible wire radiating element would be selected to be 1.2 wavelengths.

Accordingly in some embodiments and antenna comprising a flexible wire radiating element can be used to meet SAR limits and desired transmit power where a half or quarter wavelength element would not be able to meet those conditions. The flexible wire radiating element has a length that meets a specified absorption rate (SAR) for a given transmit power, nominal transmission frequency, and separation distance, and allows the given transmit power to be higher than that achievable with a half wavelength element at the same SAR and is within substantially one decibel of efficiency of an efficiency of a half wavelength element. The length of the flexible radiating element is determined according to a plot of SAR over length to determine a minimum length (e.g. FIG. 1), or an equation derived from such a plot, necessary to meet the SAR limit for the given transmit power, nominal transmission frequency, and separation distance. The minimum length is mapped to an electrical length corresponding to a peak in a horizontal efficiency plot over length for an unterminated wire, such as that shown in FIG. 2. The electrical length corresponding to the peak is greater than or substantially equal to the minimum length.

Accordingly, the embodiments taught herein provide the benefit of a flexible wire radiating element for an antenna that meets a desired SAR, and has a horizontal radiating efficiency within, for example, 1 decibel (dB) of that of a half wavelength element. By picking lengths greater than one wavelength a higher transmit power can be used while still meeting the specified SAR limit. Being a flexible wire radiating element the antenna is especially suited for covert applications where the antenna and radio are hidden, for example, under the wearer's clothes.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

I claim:

1. A method of making a body-worn antenna, comprising:

determining a minimum length needed for a flexible wire radiating element to meet a desired specific absorption rate (SAR) based on transmit power applied to the body-worn antenna, a nominal transmission frequency, a transmission duty cycle, and a separation distance from a wearer's body, wherein the separation distance is non-zero and less than one inch;

selecting an electrical length for the flexible wire radiating element of the body-worn antenna based on the determined minimum length, wherein the electrical length corresponds to a peak in radiated efficiency over wavelength of the nominal transmission frequency for an unterminated wire that occurs above one wavelength and is within a preselected efficiency differential of an efficiency of a one half wavelength, and wherein the peak corresponds to an actual length that is greater than the determined minimum length; and connecting a matching network circuit between the flexible wire radiating element having the selected electrical length and an antenna feed point of the body-worn antenna.

2. The method of claim 1, wherein determining the minimum length comprises determining the minimum length based on a separation distance that is not greater than one half inch.

3. The method of claim 1, wherein determining the minimum length comprises determining the minimum length based on a separation distance that is substantially one quarter inch.

4. The method of claim 1, wherein selecting the electrical length comprises selecting the electrical length as one of a 1.2 wavelength or a 1.7 wavelength equivalent.

5. The method of claim 1, further comprising mounting the flexible wire radiating element in a separator that maintains the separation distance.

6. The method of claim 1, wherein determining the minimum length comprises determining the minimum length based on the transmit power being at least 3 watts.

7. The method of claim 1, wherein determining the minimum length comprises determining the minimum length based on the transmission duty cycle being not greater than 50%.

8. The method of claim 1, wherein the body-worn antenna operates in an 800 MHz radio frequency range.

9. A body-worn antenna, comprising:

a connector that couples to a portable radio device and has a feed point;

a flexible wire radiating element having an electrical length that exceeds a minimum length needed for the flexible wire radiating element to meet a desired specific absorption rate (SAR) based on transmit power applied to the body-worn antenna, a nominal transmission frequency, a transmission duty cycle, and a separation distance from a wearer's body, wherein the separation distance is non-zero and less than one inch, wherein the electrical length corresponds to a peak in radiated efficiency over wavelength of the nominal frequency for an unterminated wire that occurs above one wavelength and is within a preselected efficiency differential of an efficiency of a one half wavelength, and wherein the peak corresponds to an actual length that is greater than the determined minimum length; and a matching network coupled between the feed point of the connector and the flexible wire radiating element.

10. The body-worn antenna of claim 9, wherein the separation distance is not greater than one half inch.

11. The body-worn antenna of claim 10, wherein the separation distance that is substantially one quarter inch.

12. The body-worn antenna of claim 9, wherein the electrical length is one of a 1.2 wavelength or a 1.7 wavelength equivalent.

13. The body-worn antenna of claim 9, wherein the flexible wire radiating element is mounted in a separator that maintains the separation distance.

14. The body-worn antenna of claim 9, wherein the transmit power is at least 3 watts.

15. The body-worn antenna of claim 9, wherein the transmission duty cycle is not greater than 50%.

16. The body-worn antenna of claim 9, wherein the body-worn antenna operates in an 800 MHz radio frequency range.

17. A covert radio apparatus, comprising:

a portable radio device that operates at a nominal frequency and has an antenna connector;

a body-worn antenna including:

a connector that couples to a portable radio device and has a feed point;

a flexible wire radiating element having an electrical length that exceeds a minimum length needed for the flexible wire radiating element to meet a desired specific absorption rate (SAR) based on transmit power applied to the body-worn antenna, a nominal transmission frequency, a transmission duty cycle, and a separation distance from a wearer's body, wherein the separation distance is non-zero and less than one inch, wherein the electrical length corresponds to a peak in radiated efficiency over wavelength of the nominal frequency for an unterminated wire that occurs above one wavelength and is within a preselected efficiency differential of an efficiency of a one half wavelength, and wherein the peak corresponds to an actual length that is greater than the determined minimum length; and a matching network coupled between the feed point of the connector and the flexible wire radiating element.

18. The covert radio apparatus of claim 17, wherein the separation distance is not greater than one half inch.

19. The covert radio apparatus of claim 17, wherein the separation distance that is substantially one quarter inch.

20. The covert radio apparatus of claim 17, wherein the electrical length is one of a 1.2 wavelength or a 1.7 wavelength equivalent.

21. The covert radio apparatus of claim 17, wherein the flexible wire radiating element is mounted in a separator that maintains the separation distance.

22. The covert radio apparatus of claim 17, wherein the transmit power is at least 3 watts.

23. The covert radio apparatus of claim 17, wherein the body-worn antenna operates in an 800 MHz radio frequency range.

24. An antenna comprising:

a flexible wire radiating element that has a length that meets a specified absorption rate (SAR) for a given transmit power, nominal transmission frequency, and separation distance, and allows the given transmit power to be higher than that achievable with a half wavelength element at the same SAR and is within substantially one decibel of efficiency of an efficiency of a half wavelength element, wherein the length of the flexible radiating element is determined according to a plot of SAR over length to determine a minimum length necessary to meet the SAR limit for the given transmit power, nominal transmission frequency, and separation distance, and wherein the minimum length is mapped to an electrical length corresponding to a peak in a horizontal efficiency plot over length for an unterminated wire, wherein the electrical length corresponding to the peak is not less than the minimum length.

25. The antenna of claim 24, wherein the electrical length is one of a 1.2 wavelength or a 1.7 wavelength equivalent.

26. The antenna of claim 24, wherein the transmit power level used for the given transmit power is at least 3 watts.

27. The antenna of claim 24, wherein the antenna operates in an 800 MHz radio frequency range.

* * * * *